US008264814B2

(12) United States Patent
Love et al.

(10) Patent No.: US 8,264,814 B2
(45) Date of Patent: Sep. 11, 2012

(54) DOWNHOLE SEQUENTIALLY-FIRING CASING PERFORATING GUN WITH ELECTRONICALLY-ACTUATED WIRELINE RELEASE MECHANISM, AND ACTUATION CIRCUIT THEREFOR

(75) Inventors: Lyle G. Love, Weatherford, OK (US); Michael W. Dobrinski, Weatherford, OK (US); Frank L. Lezu, Jr., Weatherford, OK (US); John R. Harris, Weatherford, OK (US); Brian S. Buffington, Weatherford, OK (US); Sanford E. Stark, Weatherford, OK (US)

(73) Assignee: Casedhole Solutions, Inc., Weatherford, OK (US)

( * ) Notice: Subject to any disclaimer, the term of this patent is extended or adjusted under 35 U.S.C. 154(b) by 505 days.

(21) Appl. No.: 12/565,503

(22) Filed: Sep. 23, 2009

(65) Prior Publication Data

US 2011/0067854 A1 Mar. 24, 2011

(51) Int. Cl.
*G01V 1/06* (2006.01)

(52) U.S. Cl. ..... 361/248

(58) Field of Classification Search ..... 361/248
See application file for complete search history.

(56) References Cited

U.S. PATENT DOCUMENTS 3,402,391 A * 9/1968 Howard et al. ..... 340/3.9
5,531,164 A * 7/1996 Mosley ..... 102/312
5,700,969 A * 12/1997 Mosley ..... 102/313
6,315,043 B1 * 11/2001 Farrant et al. ..... 166/297
7,007,756 B2 * 3/2006 Lerche et al. ..... 166/297
7,387,162 B2 * 6/2008 Mooney et al. ..... 166/297
2002/0053434 A1 * 5/2002 Chen et al. ..... 166/297
2004/0108114 A1 * 6/2004 Lerche et al. ..... 166/302
2011/0067854 A1 * 3/2011 Love et al. ..... 166/55.1
2011/0090091 A1 * 4/2011 Lerche et al. ..... 340/853.2

OTHER PUBLICATIONS

"Perforating Accessories—Thru-Tubing Release Systems." HPI: Thru Tubing Gun Release. High Pressure Integrity, Inc., n.d. Web. accessed Jun. 12, 2009.
"Light Duty: Thru-Tubing Release System." Technical Specification. High Pressure Integrity, Inc., n.d.
"Medium Duty: Thru-Tubing Release System." Technical Specification, pp. 1-2. High Pressure Integrity, Inc., n.d.
"High Pressure/High Temperature Thru-Tubing Release Systems." Technical Specification, pp. 1-2. High Pressure Integrity, Inc., n.d.
"PERF-FRAQ System." Baker Hughes: Advancing Reservoir Performance. Baker Hughes Incorporated, n.d. Web. accessed Jun. 15, 2009.
"NEO Trip (One Trip Perforating)" Baker Hughes: Advancing Reservoir Performance. Baker Hughes Incorporated, n.d. Web. accessed Jun. 15, 2009.
"Horizontal Oriented Perforating System (HOPS)" Baker Hughes: Advancing Reservoir Performance. Baker Hughes Incorporated, n.d. Web. accessed Jun. 15, 2009.

* cited by examiner

*Primary Examiner* — Ronald W Leja
(74) *Attorney, Agent, or Firm* — Brett T. Cooke; Andrews Kurth LLP

(57) ABSTRACT

A downhole release tool for use in conjunction with multiple select-fire perforating guns and a method for electronically actuating the release tool using either positive or negative control voltage. In a preferred embodiment, the release tool employs operating circuitry that allows actuation of the release tool by either a positive or a negative voltage at an absolute magnitude greater than the absolute magnitude of positive or negative voltages used to arm or fire the perforating guns.

12 Claims, 6 Drawing Sheets

DOWNHOLE SEQUENTIALLY-FIRING CASING PERFORATING GUN WITH ELECTRONICALLY-ACTUATED WIRELINE RELEASE MECHANISM, AND ACTUATION CIRCUIT THEREFOR

BACKGROUND OF THE INVENTION

1. Field of the Invention

This invention relates generally to perforating well casing, and in particular to an improved apparatus for perforating casing and fracturing multiple formations of highly deviated oil and gas wells in a single trip. More particularly, this invention relates to an improved electronic downhole release tool and actuation circuit therefore that is compatible with multiple select-fire perforating guns.

2. Background Art

Referring to FIG. 1A, after a well is drilled, the open borehole is typically lined; casing (2) is run into the borehole and cemented in place. In order to allow fluid ingress into the lined well, a perforating gun (14) is then lowered into the cased hole for forming openings (3) through the casing at selected locations within the subterraneous formations. The perforating gun (14) usually is made up of shaped charges that are detonated by a blasting cap. The blasting cap is activated by electrical current.

Perforating guns (14) are often deployed using wireline techniques, in which a wire rope or an armored electrical cable (8) is used to suspend the tool in the well bore. Occasionally, as illustrated in FIG. 1B, perforating guns (14) become stuck in the well bore due to warpage or burrs that occur during the detonation process. Because of this possibility, wireline systems typically include a weak link that can be sheared under a predetermined wireline tension so that the wireline (8) can be pulled free, leaving the downhole tools in the bore to be fished out by conventional means.

An improvement over the mechanical weak link is an electrically actuated release tool (10). The release tool (10) is located above the perforating gun (14) (and typically below a casing collar locator (13), sinker bars (12) and the wireline cable head (11)). The release tool (10) has two halves and uses current-activated explosive charges to shear a tension stud (21) to separate its upper portion (10A) from its lower portion (10B). In this manner, the wireline (8) and upper tool string above release tool (10) is, by electrical actuation, severed from the lower portion of the tool string below the release tool (10). The release tool (10) is designed so that when it is parted, the exposed upper end (20) of the lower tool string has a profile that facilitates the fishing process. As electric wireline perforating guns (14) are typically activated by positive DC voltage, the release tool (10) uses a negative DC voltage triggering source. Release tools (10) as described above are available from High Pressure Integrity, Inc. of New Orleans, La., for example.

In many wells it is desirable to perforate casing over greater distances in the wellbore than can be accommodated by one perforating gun. To avoid running perforating guns and withdrawing the spent charges from the wellbore repeatedly, it is advantageous to place a number of perforating charges or groups of charges in the well simultaneously. Select charges are individually fired as the perforating guns are moved along the cased borehole. This technique is called "select-fire," and it is known in the art.

Examples of apparatus for selectively firing perforating charges are disclosed in U.S. Pat. Nos. 5,531,164 issued to Mosley on Jul. 2, 1996; 5,700,969 issued to Mosley on Dec. 23, 1997; and 7,387,162 issued to Mooney, Jr., et al. on Jun. 17, 2008, which are incorporated herein by reference. The electrical circuits in the devices are designed such that charges are fired sequentially by alternately applying negative and positive electrical voltages to the device.

Although most other electric wireline tools are powered with positive voltage, select fire perforating guns typically use both positive and negative voltage to selectively control the firing process. Thus, select-fire perforating guns have heretofore not been used with negative-voltage actuated electric release tools because of the conflicting operating voltages of the devices. Although additional conductors can be provided within the wireline to remedy conflicting voltages, such a solution is often not cost-effective, particularly given the capital costs in replacing existing wireline cable. As a result, if a select fire perforating gun becomes stuck down hole, wireline retrieval is generally limited to reliance on a weak point built into the system to allow the wireline to be pulled free by breaking the weak point.

However, when down hole tools are deployed in a highly deviated wellbore or a horizontal wellbore it may be extremely difficult to pull directly on the rope socket with sufficient force to part the weak link, because the wireline friction due to contact with the deviated bore hole becomes great. Therefore, as select-fire perforation becomes more prolific, it is desirable to provide the combination of an electric release tool with multiple-charge, select fire, perforating guns to provide for efficient perforation operations, particularly in highly-deviated well bores.

3. Identification of Objects of the Invention

A primary object of the invention is to provide a method and apparatus for performing electric wireline operations, especially select-fire perforating operations, with the ability to activate a release tool using either positive voltage or negative voltage.

Another object of the invention is to provide a method and apparatus for allowing a wireline operator to release a select-fire perforating gun from the wireline by electronic means rather than mechanical pulling on the rope socket.

SUMMARY OF THE INVENTION

The objects described above and other advantages and features of the invention are incorporated in a method and a wireline system that allows the wireline operator to release the down hole tools from the wireline on demand by using an electronic release tool as opposed to breaking a weak point by pulling on the wireline, regardless of downhole tool configuration. This ability allows the wireline operator to deploy the tools with a much stronger weak point and allows the tools to be released electronically instead of breaking a weak point, which can be difficult in a highly deviated or horizontal wellbore.

In a preferred embodiment, the system includes a downhole string having an electric release tool and multiple select-fire perforating guns. The release tool employs operating circuitry that allows actuation of the release tool by either a positive or a negative voltage at an absolute magnitude greater than the absolute magnitude of positive or negative voltages used to arm or fire the perforating guns.

BRIEF DESCRIPTION OF THE DRAWINGS

The invention is described in detail hereinafter on the basis of the embodiments represented in the accompanying figures, in which.

DESCRIPTION OF THE PREFERRED

Embodiment of the Invention

Figure 1B:
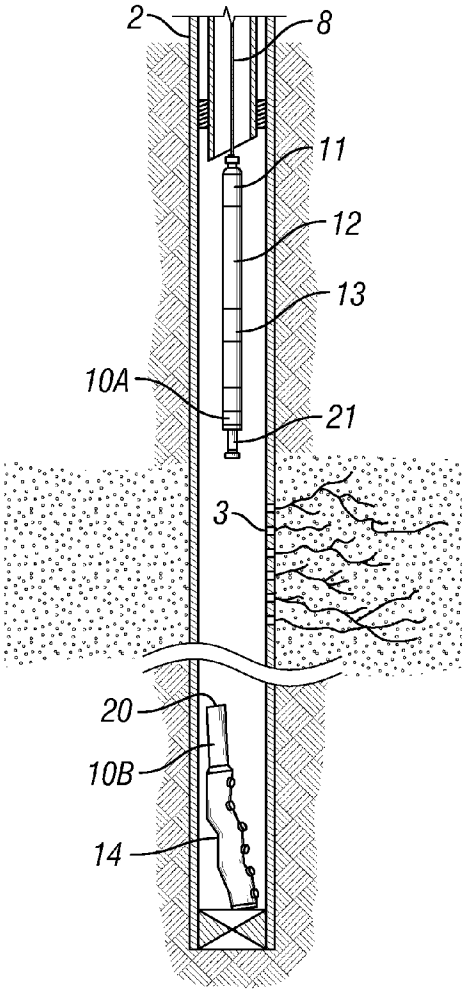
FIG. 1B (Prior Art)
FIG. 1B illustrates the single-fire perforating tool string of FIG. 1A in which the perforating gun has become warped and the release tool has parted the warped perforating gun from the upper portion of the tool string.
Figure 1A:
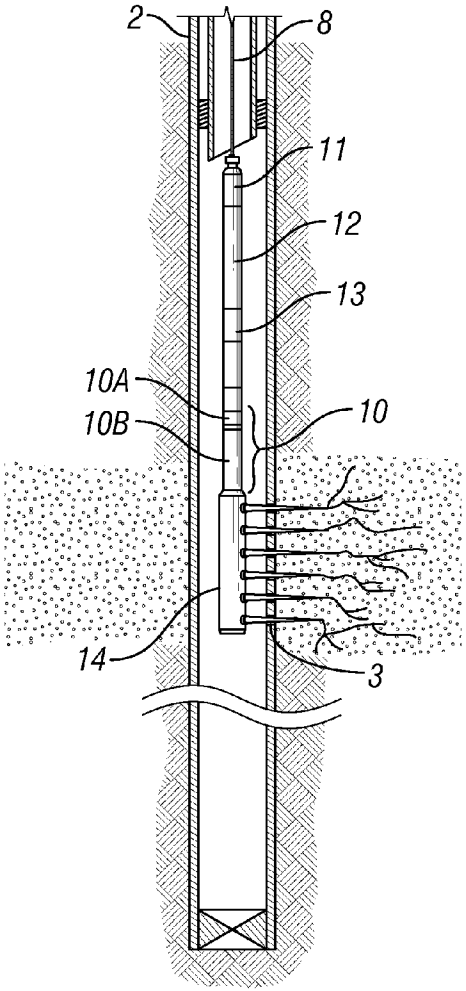
FIG. 1A (Prior Art)
FIG. 1A illustrates a single-fire perforating gun suspended by an electric wireline system including an electrically actuated release tool as known in the art.
Figure 2A:
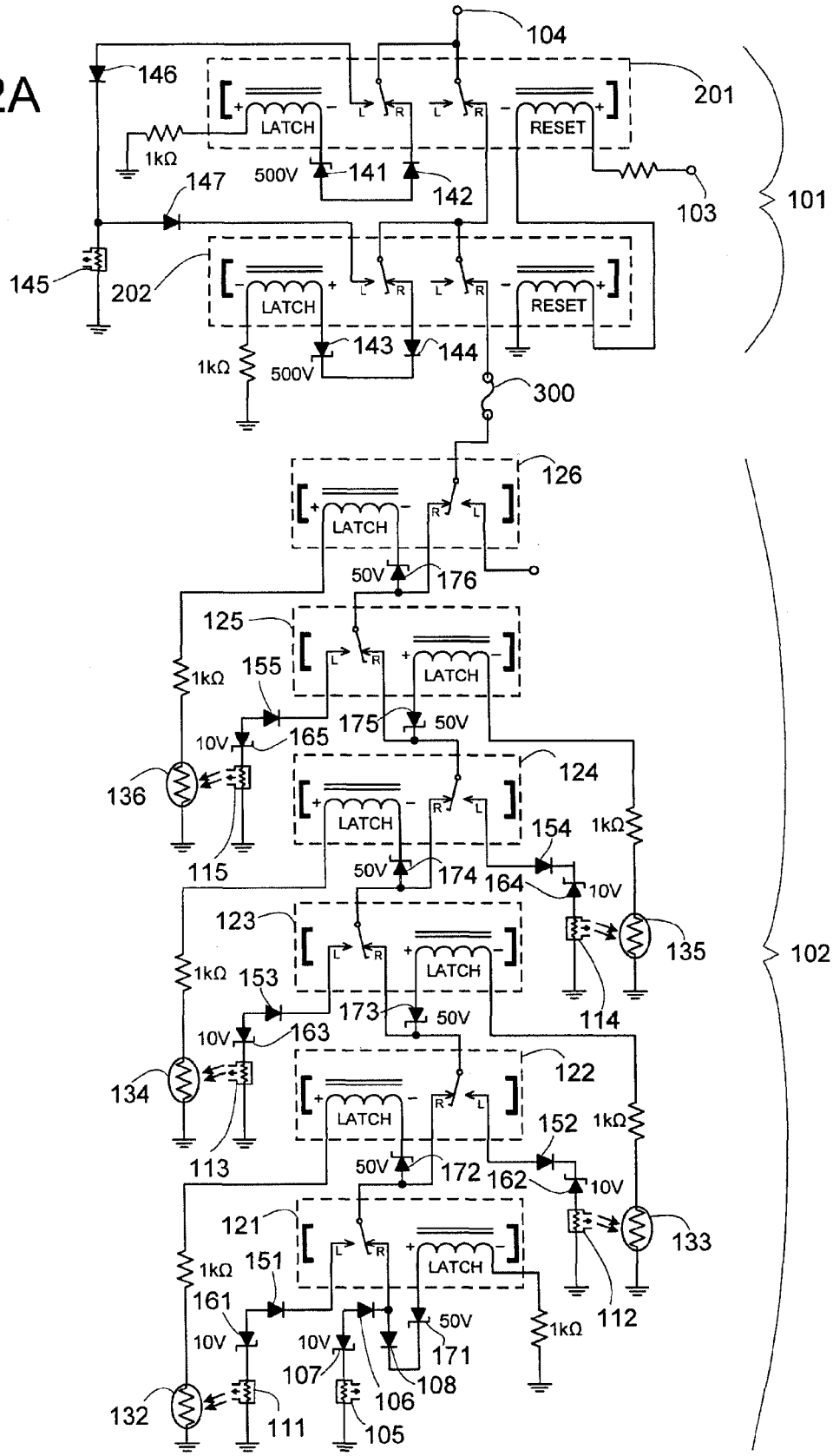
FIG. 2A is an electrical schematic diagram of the release tool actuation circuitry according to a preferred embodiment of the invention in combination with select-fire perforating gun circuitry, shown with relays in the unlatched reset positions for setting an optional bridge plug.

FIG. 2A is a circuit schematic diagram that illustrates the operation of the release tool actuation circuit in conjunction with the select-fire perforating gun firing circuit according to a preferred embodiment of the invention. The release tool actuation circuitry is shown generally at 101, and the perforating gun select-fire circuitry is shown generally at 102. Preferably, release tool circuitry 101 is connected to the perforating gun select-fire circuitry 102 by a fuse 300. Fuse 300 will blow if there is a short in circuitry 102, thus allowing one to actuate the release tool as described below.

The perforating gun select fire circuitry 102 preferably consists of a series of blasting caps, squibs, or other ignitors 111, 112, 113, 114, 115 for detonating the perforating charges. Each blasting cap 111, 112, 113, 114, 115 within the series is triggered by a DC voltage of alternating polarity from the adjacent blasting caps in the series. Each blasting cap 111, 112, 113, 114, 115 preferably has an associated arming circuit that typically consists of a magnetic latching relay 121, 122, 123, 124, 125, 126 and a photocell 132, 133, 134, 135, 136, respectively. The magnetic latching relays 121, 122, 123, 124, 125, 126 are connected to form a cascading series, with the arming and triggering control voltages initially passing through each relay in the cascade.

The cascading relays 126 in the select fire circuitry 102 are connected in tandem with two release tool arming relays 201, 202 and to an input node 104. Control voltage from the surface is transmitted by wireline to the input node 104 of release tool actuation circuit 101, which in normal mode of operation is conducted along the cascading series of relays 126, 125, 124, 123, 122, 121.

Normal operation of the select fire circuitry 102 is now described. Select fire circuitry 102 includes an optional ignitor 105 for setting a bridge plug. Because relays 201, 202, 126, 125, 124, 123, 122 and 121 are initially in the unlatched or reset position, a direct signal path connects node 104 to ignitor 105 through the cascade of relays. Setting tool ignitor 105 is fired by applying a voltage of approximately −100 VDC at input node 104. Therefore, there is about a 0.7 volt drop across the forward-biased diode 106, a 10V drop across zener diode 107, and a 89.3V drop across ignitor 105, which causes the setting tool to stroke and set the bridge plug, as is well known in the art.

While setting the bridge plug, no current passes through the coils of the relays. When the −100 VDC bridge plug setting control voltage is applied at node 104, blocking diode 108 prevents current from flowing through the latching coil of arming relay 121. Insufficient current flows through the latching coils to switch any of the arming relays 122, 123, 124, 125, 126, because photocells 132, 133, 134, 135 and 136, which are in darkness, all have a large resistance—on the order of 1 MΩ, for example. Blocking diode 144, which is reverse biased, prevents current from flowing through the latching coil of release tool actuation relay 202. Finally, zener diode 141, which has a breakdown voltage of 500V, prevents current from flowing through the latching coil of release tool actuation relay 201.

Figure 2B:
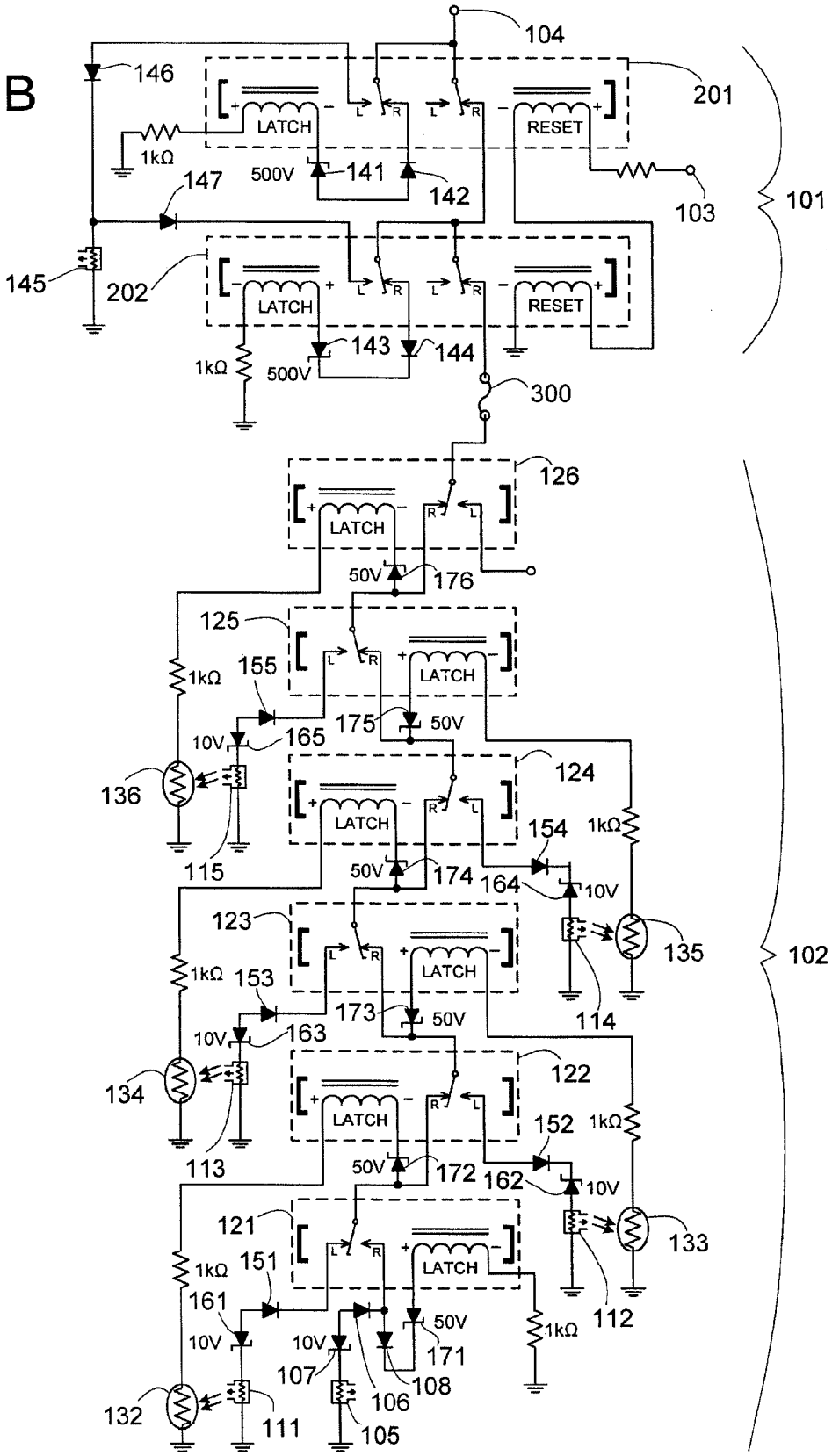
FIG. 2B is the electrical schematic diagram of FIG. 2A wherein a first arming relay in a cascading series of relays is latched for arming a negative-voltage triggered firing circuit for a first perforating gun.

After the bridge plug has been set, or if it is not desired to set a bridge plug, the firing circuit for gun number one is armed by applying +100 VDC at node 104. Diode 108 becomes forward-biased, zener diode 109 enters the breakdown region of operation, and current flows through the latching coil of arming relay 121 and through the 1 kΩ resistor to the circuit ground. The latching coil causes the relay contact to switch to the latched position as shown in FIG. 2B, which connects node 104 to blasting cap 111.

Note that the +100 VDC does not actuate ignitor 105 (if it has not been previously actuated to set a bridge plug), because blocking diode 106 is reverse-biased. Likewise, photocells 132, 133, 134, 135, 136 prevent arming relays 122, 123, 124, 125, 126 from latching, zener diode 143 prevents release tool relay 202 from latching, and blocking diode 142 prevents release tool relay 201 from latching.

Once the firing circuit for gun number one is armed (i.e., relay 121 is in the latched position), application of −60 VDC at node 104 will cause diode 151 to become forward-biased, zener diode 161 to enter the breakdown region, and a voltage drop of approximately −49.3V across blasting cap 111. The voltage drop across blasting cap 111 causes gun number one to fire.

As with the previously applied negative bridge plug setting voltage, the negative gun firing voltage does not switch relays 201, 202, because of zener diode 141 and blocking diode 144, respectively. Nor does the −60 VDC gun number one firing control voltage latch arming relays 123, 124, 125, 126, because of the high resistances of photocells 133, 134, 135, and 136, respectively. However, photocell 132 is physically disposed near to blasting cap 111 so that the flash of light from the primer cord of blasting cap 111 will shine upon photocell 132. In this manner, as gun number one fires, illuminated photocell 132 becomes about one thousand times more conductive, for example. Subtracting a breakdown voltage drop of 50V across zener diode 172, there exists a 10V drop across the series combination of photocell 132, a 1 kΩ resistor, and the latching coil of relay 122. When photocell 132 is illuminated, sufficient current flows through the latching coil to switch relay 122 and thereby arm the gun number two firing circuitry, as shown in FIG. 2C.

Figure 2C:
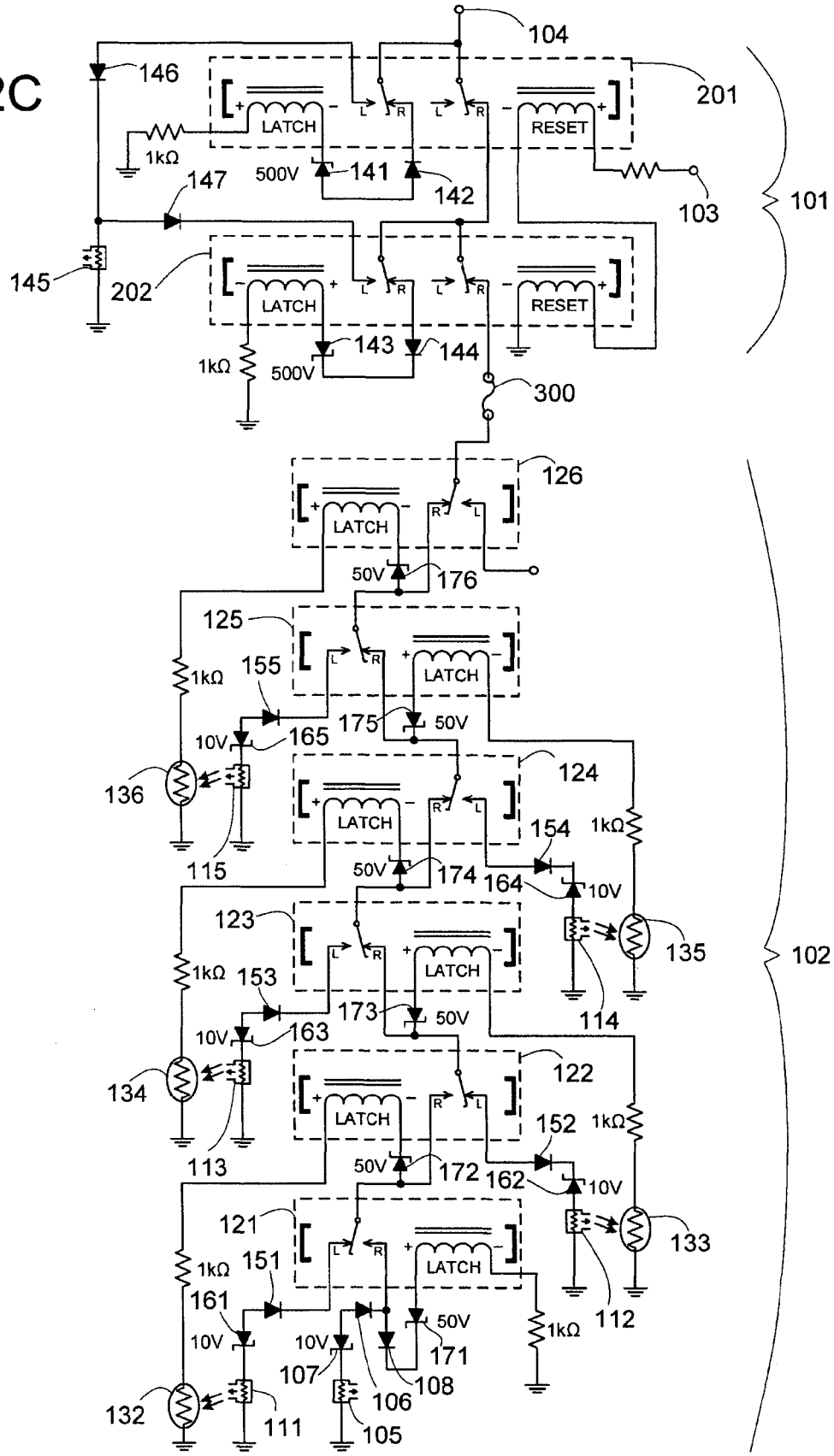
FIG. 2C is the electrical schematic diagram of FIG. 2B wherein a second arming relay is latched for arming a positive-voltage triggered firing circuit for a second perforating gun.

Referring to FIG. 2C, gun number two is fired by application of +60 VDC to node 104, which causes diode 152 to become forward-biased, zener diode 162 to enter the breakdown region of operation, and current to flow through blasting cap 112. Firing gun number two illuminates photocell 133, which causes relay 123 to latch and arm gun number three.

This process of firing and arming the next gun in the sequence may continue along the cascade for as many guns as are equipped on the down hole tool.

FIGS. 2A-2C illustrate a tool with five guns, which correspond to blasting caps 111, 112, 113, 114 and 115, respectively. An extra arming relay 126 with photocell 136 is provided for connection to additional guns as desired.

The release tool circuitry 101 is preferably connected at the input to the cascade of gun firing circuitry 102 regardless of how many guns are employed. In normal operation, release tool actuation relays 201 and 202 are never latched. However, if the tool becomes stuck, or it is otherwise necessary to electronically actuate the release tool to sever the wireline connection to the perforating guns, application of either +500 VDC or −500 VDC to node 104 will electrically disconnect the gun firing circuitry 102 from input node 104 and arm the release tool ignitor 145.

Figure 2D:
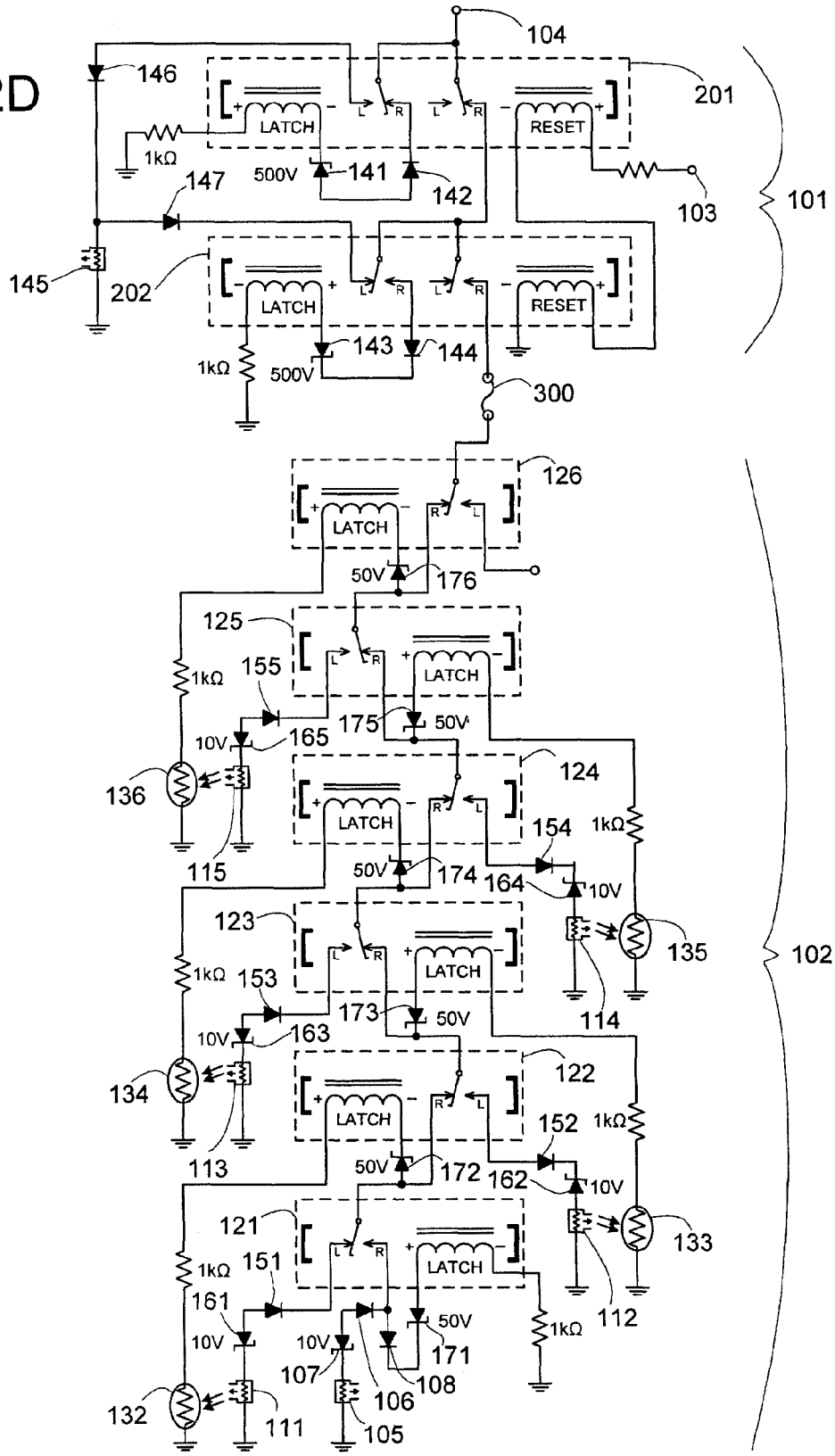
FIG. 2D is the electrical schematic diagram of FIG. 2B wherein the release tool actuation circuit has been armed by application of +500 VDC.
Figure 2E:
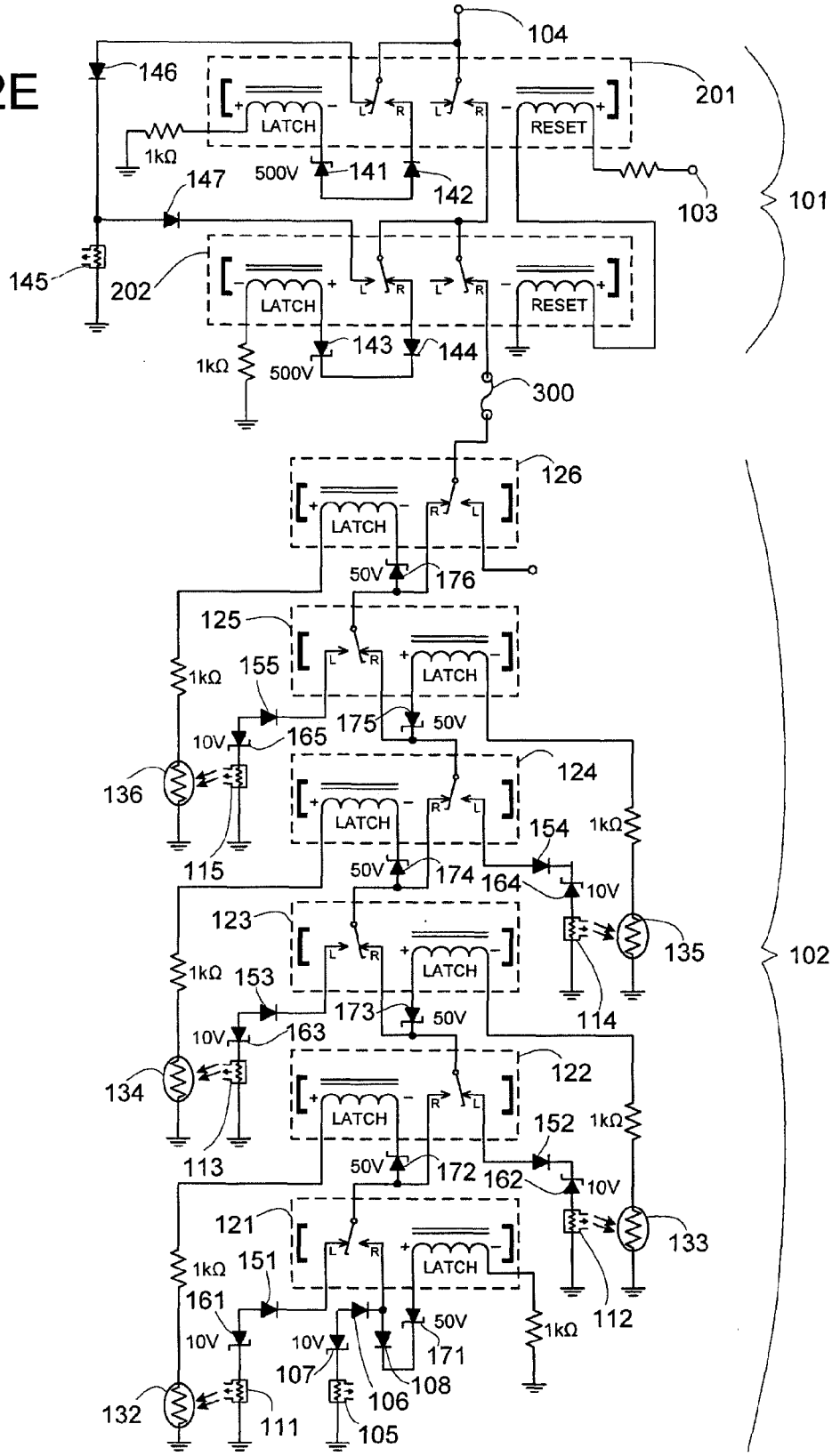
FIG. 2E is the electrical schematic diagram of FIG. 2C wherein the release tool actuation circuit has been armed by application of −500 VDC.

In operation, the release tool circuitry 101 works as follows: Referring to FIG. 2B, assume that gun number one is armed but has not yet been fired. Application of −60 VDC at input node 104 will cause gun number one to fire. If it is desired to actuate the release tool without firing gun number one, then it is necessary to use positive actuating voltage. Thus, +500 VDC is applied at node 104. Given the high resistance levels of photocells 132, 133, 134, 135 and 136, this 500V potential is insufficient to latch relays 122, 123, 124, 125 and 126. Zener diode 143 enters the breakdown region of operation and relay 202 switches to the latched position, as shown in FIG. 2D. A subsequent application of negative voltage at node 104 forward-biases diode 147 and is used to actuate release tool ignitor 145, which fires an explosive shear bolt and releases the tool from the wireline.

Referring to FIG. 2C, gun number two is armed but has not yet been fired. Application of +60 VDC at node 104 will fire gun number two. Thus, if it is desired to actuate the release tool at this stage in the perforation process, it is necessary to apply negative actuation voltage rather than positive actuation voltage. In this case, −500 VDC is applied at node 104, which forward-biases diode 142, causes zener diode 141 to operate in the breakdown region, and switches relay 201. Subsequent application of positive voltage forwarded biases diode 146 and fires release tool ignitor 145.

Optional reset circuitry may be provided. If after latching either release tool relay 201 or 202 it is desired to resume perforating operations without releasing the tool, voltage may be applied to separate reset coils in relays 201, 202 via reset node 103, which will reset the tool to its previous state without firing release tool ignitor 145 or any of the perforating guns.

In a preferred embodiment, release tool relays 201, 202 are double-pole double-throw high temperature magnetic latching relays such as the 422H relay, available from Teledyne® Relays. However, other suitable relays may be used. As selection of electronic and electrical components that are suitable for downhole use is a known skill of routineers in the art, further detail is not provided herein.

The Abstract of the disclosure is written solely for providing the United States Patent and Trademark Office and the public at large with a way by which to determine quickly from a cursory reading the nature and gist of the technical disclosure, and it represents solely a preferred embodiment and is not indicative of the nature of the invention as a whole.

While some embodiments of the invention have been illustrated in detail, the invention is not limited to the embodiments shown; modifications and adaptations of the above embodiment may occur to those skilled in the art. Such modifications and adaptations are in the spirit and scope of the invention as set forth herein:

What is claimed is:

1. A downhole tool (10) comprising:

a first end (10A);

a second end (10B) releasably coupled to said first end (10A);

an actuator (145) coupled to said first and second ends (10A, 10B) and arranged for parting said second end (10B) from said first end (10A) upon energization by an electrical current;

a conductive electrical path between said first end (10A) and said second end (10B), said electrical path defining an input node (104) at said first end (10A);

a first switch element (201) electrically connected in said conductive electrical path, said first switch element (201) arranged to connect said actuator (145) to said input node (104) upon application of negative voltage of a first predetermined level at said input node (104); and a second switch (202) element electrically connected in said conductive electrical path, said second switch element (202) arranged to connect said actuator (145) to said input node (104) upon application of positive voltage of a second predetermined level at said input node (104);

whereby said first and second switch elements (201, 202) allow said second end (10B) to be parted from said first end (10A) upon application of either negative or positive voltage at said input node (104).

2. The downhole tool (10) of claim 1 wherein:

said first switch element (201) is a latching switch element that continues to connect said actuator (145) to said input node (104) after the application of said negative voltage of said first predetermined level at said input node (104) is removed;

said second switch element (202) is a latching switch element that continues to connect said actuator (145) to said input node (104) after the application of said positive voltage of said second predetermined level at said input node (104) is removed;

said downhole tool (10) further comprising, a first actuator blocking diode (146) electrically connected between said actuator (145) and said first switch element (201) and oriented so that the cathode of said first actuator blocking diode (146) is electrically oriented toward said actuator (145), and a second actuator blocking diode (147) electrically connected between said actuator (145) and said second switch element (202) and oriented so that the anode of said second actuator blocking diode (147) is electrically oriented toward said actuator (145);

whereby when said first switch element (201) connects said actuator (145) to said input node (104), said actuator (145) is energizeable by an application of positive voltage at said input node (145); and whereby when said second switch element (202) connects said actuator (145) to said input node (104), said actuator (145) is energizeable by an application of negative voltage at said input node (104).

3. The downhole tool (10) of claim 2 wherein:

said first switch element (201) is a first latching relay having a latching coil connected to said conductive electrical path and said node (104) by a series combination of a first switch zener diode (141) and a first switch blocking diode (142), with the cathode of said first switch zener diode (141) and the anode of said first switch blocking diode (142) electrically oriented toward said latching coil of said first latching relay (201); and said second switch element (202) is a second latching relay having a latching coil connected to said conductive electrical path and said node (104) by a series combination of a second switch zener diode (143) and a second switch blocking diode (144), with the anode of said second switch zener diode (143) and the cathode of said second switch blocking diode (144) electrically oriented toward said latching coil of said second latching relay (202).

4. The downhole tool (10) of claim 3 further comprising:

first and second perforating guns (14) connected to said second end (10B).

5. The downhole tool (10) of claim 4 wherein:

said first perforating gun (14) is connected so as to be fired by a negative voltage of a third predetermined level at input node (104), said third predetermined level being less than said first predetermined level; and said second perforating gun (14) is connected so as to be fired by a positive voltage of a fourth predetermined level at said input node (104), the magnitude of said fourth predetermined level being less than the magnitude of said second predetermined level.

6. The downhole tool (10) of claim 5 wherein:

said first perforating gun (14) includes a first gun actuator (111) electrically connected in series with a first gun zener diode (161) and a first gun blocking diode (151), which in turn are electrically connectable by a first arming switch element (121) to said conductive electrical path and to said node (104); and said second perforating gun (14) includes a second gun actuator (112) electrically connected in series with a second gun zener diode (162) and a second gun blocking diode (152), which in turn are electrically connectable by a second arming switch element (122) to said conductive electrical path and to said node (104).

7. The downhole tool (10) of claim 6 wherein:

said first switch zener diode (141) is characterized by a breakdown voltage of greater absolute magnitude than the breakdown voltage of said first gun zener diode (161); and said second switch zener diode (143) is characterized by a breakdown voltage of greater absolute magnitude than the breakdown voltage of said second gun zener diode (162).

8. The downhole tool of claim 6 wherein:

said first arming witch element (121) is a latching relay having a latching coil electrically connected to said conductive electric path and said input node (104) by a first arming zener diode (171), the anode of said first arming zener diode (121) electrically oriented toward said latching coil of said first arming switch element (121);

said second arming switch element (122) is a latching relay having a latching coil electrically connected to said conductive electric path and said input node (104) by a second arming zener diode (172), the cathode of said second arming zener diode (172) electrically oriented toward said latching coil of said second arming switch element (122);

said first switch zener diode (141) is characterized by a breakdown voltage of greater absolute magnitude than the breakdown voltage of said second arming zener diode (172); and said second switch zener diode (143) is characterized by a breakdown voltage of greater absolute magnitude than the breakdown voltage of said first arming zener diode (171).

9. In a downhole release tool (10) for use in a well, including a first end connected (10A) to a second end (10B) and an actuator (145) arranged to part said second end (10B) from said first end (10A) upon energization by an electrical current, the improvement comprising:

a release tool actuation circuit (101) having first and second signal paths connected between said actuator (145) and an input node (104);

said first signal path arranged for allowing current to flow through said actuator (145) in only a first direction; and said second signal path arranged for allowing current to flow through said actuator (145) in only a second direction opposite to said first direction.

10. The downhole release tool (10) of claim 9 wherein:

said input node (104) is coupled to a wireline (8) for receiving a control voltage from the surface of the well; and said release tool actuation circuit (101) is electrically connected to perforating gun circuitry (102) so as to selectively disconnect said input node (104) from said perforating gun circuitry (102) by application of either a positive voltage of a first predetermined magnitude or a negative voltage of a second predetermined magnitude at said input node (104).

11. The downhole release tool (10) of claim 10 wherein said release tool actuation circuit (101) further comprises:

a first switch element (201) disposed in said first signal path and arranged so that said first switch element is closed upon said negative voltage of said second predetermined magnitude being applied at said input node (104); and a second switch element (202) disposed in said second signal path and arranged so that said second switch element is closed upon said positive voltage of said first predetermined magnitude being applied at said input node.

12. The downhole release tool (10) of claim 11 wherein:

said first switch element (201) is formed by contacts of a first latching relay, said latching coil of said first latching relay connected to said input node (104) by a first zener diode (141) in series with a first blocking diode (142) with the anode of said first zener diode and the cathode of said first blocking diode electrically oriented toward said node (104); and said second switch element (202) is formed by contacts of a second latching relay, said latching coil of said second latching relay connected to said input node (104) by a second zener diode (143) in series with a second blocking diode (144) with the cathode of said second zener diode (143) and the anode of said second blocking diode (144) electrically oriented toward said node (104).

* * * * *